United States Patent [19]

Borgenicht

[11] Patent Number: 4,916,924

[45] Date of Patent: Apr. 17, 1990

[54] FINGER RING REDUCING MEANS

[76] Inventor: Mark Borgenicht, 57 Eugene St., Buffalo, N.Y. 14216

[21] Appl. No.: 394,492

[22] Filed: Aug. 16, 1989

[51] Int. Cl.[4] ..... A44C 9/02

[52] U.S. Cl. ..... 63/15.5; 63/15.6

[58] Field of Search ..... 63/15.5, 15.6, 15.45, 63/15.65, 15.7, 15.8

[56] References Cited

U.S. PATENT DOCUMENTS 1,754,392 4/1930 Levin ..... 63/15.6

3,360,959 1/1968 Schechter et al. ..... 63/15.6

*Primary Examiner*—Laurie K. Cranmer

*Attorney, Agent, or Firm*—Wallace F. Neyerlin

[57] ABSTRACT

A finger ring guard in combination with a continuous circular finger ring for reducing the inside circumference of the ring. The guard consists of an elongated U-shaped attachment member with two arms having circular pads at the ends thereof, which pads have small holes in their centers and which pads slip over and pinch onto the ends of a small peg soldered on and sticking out perpendicularly from both sides of the ring. On the opposite outer side of the ring is soldered a small amount of gold or other metal creating a circular opening through and under which the guard is located and kept in place on the ring.

7 Claims, 1 Drawing Sheet

FINGER RING REDUCING MEANS

FIELD OF THE INVENTION

This invention relates to finger-ring reducing means or guards, and more particularly to a finger-ring guard that reduces the size of the finger-ring after the ring is slipped onto the finger.

BACKGROUND OF THE INVENTION

Very often it is desirable that the inside diameter or area or circumference of the finger-ring be made smaller. This is because it is a frequent occurrence that the inner node of the ring finger (and other fingers as well) becomes smaller than the inside diameter of the ring, either due to the wearer's loss of weight, or progressive age, or due to some other reason such as arthritis in the fingers. The reduction of the size of the inner node of the ring finger presents a problem since, with the reduction of the inner finger node, the inner finger knuckle usually remains the same or even increases in size. If the ring is made smaller, there would be difficulty in slipping it over the inner finger knuckle onto the inner finger node.

At any rate, the wearing of a finger-ring which has an inside diameter larger than the diameter of the finger presents several problems; e.g. the ring can twist or rotate about the finger and thus be uncomfortable to wear and/or displayed in an unsightly manner, or the ring may become so loose that it may slip off the finger and become lost.

Various proposals have been made for providing ring guards and/or other means for overcoming problems as referred to above. For example, U.S. Pat. Nos. 432,762, 1,341,218, 2,532,354, 3,218,826 and 3,362,189 relate to such devices and/or analogous devices; however each has its shortcomings and/or employ designs different from the ring guard design of the present invention.

BRIEF DESCRIPTION OF THE INVENTION

The finger ring guard or reducing means of the present invention overcomes the foregoing problems and provides for and utilizes a novel ring guard which holds a ring in place on a finger by decreasing the ring size. The guard is especially useful for elderly people with enlarged knuckles or to anyone with such knuckle problems.

Essentially the guard consists of an elongated U-shaped attachment means with two arms having circular pads at the ends thereof which pads have small holes in their centers and which pads slip over and pinch onto the ends of a small peg soldered on and sticking out perpendicularly from both sides of the ring. On the opposite outer side of the ring is soldered a small amount of gold or other metal creating a circular opening through and under which the guard is located and kept in place on the ring. It is to be noted, however, that the U-shaped member of the guard is not soldered or fixedly attached to the ring or in the circular opening but instead its arc-shaped end can swing freely from or within the circular opening when the ring is not in use. The pads at the ends of the guard prevent the U-shaped member of the guard from slipping through the opening and disengaging from the ring.

DETAILED DESCRIPTION OF THE INVENTION

The present invention will now be described in detail by reference to the accompanying drawings, in which.

DETAILED DESCRIPTION OF THE DRAWINGS

Figure 1:
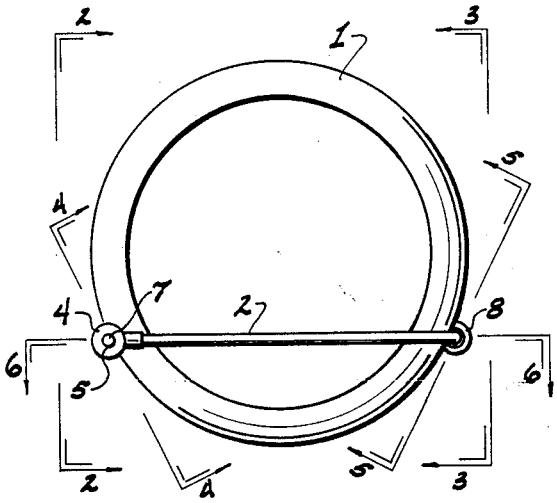
FIG. 1 is a side view of a ring with the ring guard in closed position as it would be on the wearer's finger.
Figure 5:
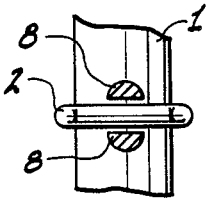
FIG. 5 is a section view taken along the line 5—5 of FIG. 1.
Figure 8:
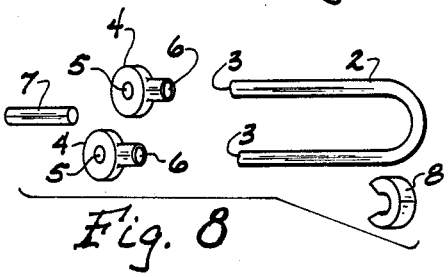
Figure 9:
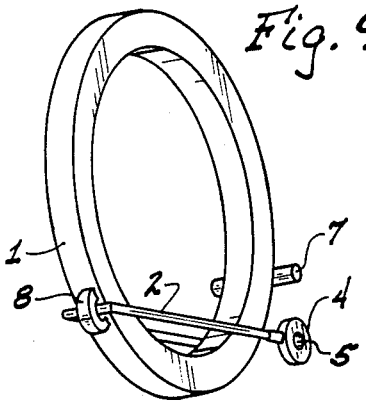
FIG. 9 is a perspective view of a ring with the ring guard mounted on the ring but in an open position as it would be before it is fitted over the wearer's finger.

In FIG. 1, and other figures as well, the ring to which the guard is to attached is identified as item 1. The U-shaped member of the guard assembly is 2 and this is looped through circular member 8 after member 8 is soldered to the circumference of the ring, in a direction parallel to the circumference of the ring, as is illustrated in FIG. 9. Member 8 can be semi-circular or three-quarter circular (as shown in FIG. 8) or fully circular, just so long as the hole in same is sufficient in size as to permit the arc end of the U-shaped member 2 to move or pivot up or down within same (illustrated in FIGS. 5 and 6).

The ends 3 of the U-shaped member 2, after the member is looped through circular member 8 are designed in size and shape so as to fit into hollow ends 6 of matched pads or "grabbers" 4. Member 2 is typically made of 17–20 gauge wire and is generally made slightly extra long so that it can conveniently be shortened to the desired length. After being so shortened and fitted into said hollow ends 6 it is then soldered to the "grabbers", with the grabbers parallel to the circumference of the ring, as shown in FIGS. 1, 2, 6 and 9.

Figure 4:
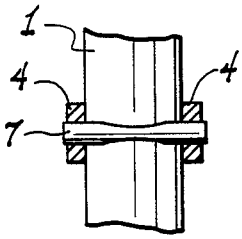
FIG. 4 is a section view taken along the line 4—4 of FIG. 1.
Figure 6:
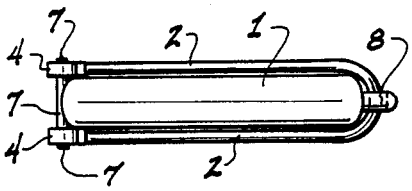
FIG. 6 is a section view taken along the line 6—6 of FIG. 1.
Figure 7:
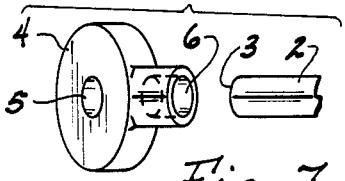
FIGS. 7 and 8 are perspective views of members of the ring guard and are set forth to illustrate a mass-production design for producing the ring guard.

The guard assembly also includes pin 7, which is soldered onto the circumference of the ring in a direction perpendicular to the circumference, as illustrated in FIGS. 4, 6 and 9. Pin 7 is so located on the ring a distance from circular member 8 such as to provide the amount of reduction of ring size or diameter as is desired and as will enable the ring to be held firmly around the finger without discomfort to the wearer.

In any event, a reduction of at least 10% in the diameter of the ring will be effected, and in most cases, a higher percentage reduction in diameter, such as 15 to 35% will be designed to be effected for the wearer.

Figure 2:
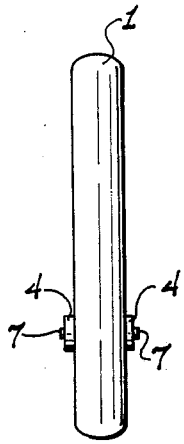
FIG. 2 is an end view of the assembly taken along the line 2—2 of FIG. 1.
Figure 3:
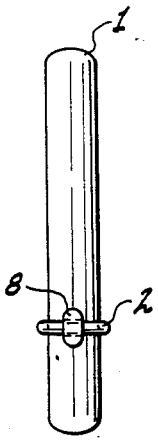
FIG. 3 is an end view of the assembly taken along the line 3—3 of FIG. 1.

The holes 5 in the pads or grabbers 4 will have approximately the same diameter as the pin 7 so as to snugly fit over the ends of the pin and pinch onto same. The width of the grabbers 4 will also be substantially the same as the distance that the pin 7 projects beyond the outside of the ring, as is illustrated in FIGS. 2, 4 and 6.

When not in use the guard is capable of swinging freely from the ring within circular member 8 which is soldered to the ring. After putting the ring on the finger, the wearer swings the two arms of the U-shaped member 2 up around the ring to their pad positions over pin 7 and the pads are pushed down over each end of the pin, one arm at a time. To remove the ring, the wearer uses his or her fingernail to pry the arms off of the pin, one pad at a time and swings the guard down.

The U-shaped member 2, the pin 7 and the circular member 8 are all typically made of 10 or 14 karat gold wire (17–20 gauge).

The foregoing description of the invention and uses thereof are intended to illustrate the invention without limiting it thereby. It will be understood that various modifications can be made in the invention without departing from the spirit or scope thereof.

What is claimed is:

1. A finger ring guard in combination with a continuous circular finger ring for reducing the inside circumference of the ring, said guard consisting essentially of a U-shaped member having a bight portion and two legs extending therefrom wherein the bight portion is pivotally attached to the ring and the legs terminate in substantially circular pads having central holes therein through which the ends of a peg perpendicularly affixed to an outside edge of the ring extend, and wherein the width of the guard is approximately the same as the width of the ring, and the length of which is sufficient so that it is capable of reducing the inner diameter of the ring by at least about 10 percent.

2. A finger ring guard according to claim 1 wherein said U-shaped guard and said peg are formed from a solid wire; a circular-shaped hollow member is soldered on the outer circumference of the ring such that its central longitudinal axis extends parallel to the central longitudinal axis of the ring; and said circular pads each have a hollow tube extending therefrom which are soldered to the ends of the legs of the U-shaped member.

3. A finger ring guard according to claim 1 wherein the holes in said circular pads are drilled to fit snugly over the peg.

4. A finger ring guard according to claim 3 wherein the peg at each of its ends extends a distance about the thickness of the circular pad.

5. In combination, a finger ring guard and a continuous circular finger ring, said ring guard being pivotally used to reduce the inside circumference of the ring, said guard consisting essentially of a U-shaped member having a bight portion and two free ends, the width of which guard is approximately the same as the width of the ring to which it is pivotally affixed, and the length of which is sufficient that it is capable of reducing the inner diameter of the ring at least about 10%, and the free ends of said guard terminate in substantially circular pads having central holes therein which grab onto the ends of a peg perpendicularly affixed to the outside edge of the ring to which the guard is pivotally attached.

6. A combination according to claim 5 wherein the holes in said circular pads are drilled to fit snugly over the peg.

7. A combination according to claim 5 wherein the peg at each of its ends extends a distance about the thickness of the circular pad.

* * * * *